United States Patent [19]

Aoki

[11] Patent Number: 4,979,708

[45] Date of Patent: Dec. 25, 1990

[54] FANCY TOOTHBRUSH HOLDER

[75] Inventor: Mitsuo Aoki, Shizuoka, Japan

[73] Assignee: Suruga Kogyo Kabushiki Kaisha, Fujieda, Japan

[21] Appl. No.: 410,421

[22] Filed: Sep. 21, 1989

[30] Foreign Application Priority Data

Sep. 21, 1988 [JP] Japan ..... 63-123903[U]

[51] Int. Cl.[5] ..... A46B 17/02

[52] U.S. Cl. ..... 248/110; 248/206.2; 248/309.1

[58] Field of Search ..... 248/110, 542, 206.1, 248/206.2, 206.3, 206.4, 309.1, 362; 211/65, 66, 70.1; D6/528, 529, 530, 531, 534

[56] References Cited

U.S. PATENT DOCUMENTS

| | | | |
|---|---|---|---|
| 2,051,847 | 8/1936 | Halstead | 248/206.4 X |
| 2,259,848 | 10/1941 | Ward | D6/530 X |
| 2,760,681 | 8/1956 | Arquelles et al. | D6/530 X |
| 2,797,886 | 7/1957 | Pinckney | 248/206.3 X |
| 3,138,813 | 6/1964 | Kaplan | D6/534 X |
| 3,170,265 | 2/1965 | Goldfarb | D6/534 X |
| 4,589,159 | 5/1986 | Streibel | 211/66 X |

FOREIGN PATENT DOCUMENTS

| | | | |
|---|---|---|---|
| 206496 | 11/1956 | Australia | 211/65 |

*Primary Examiner*—David M. Purol

*Attorney, Agent, or Firm*—Fleit, Jacobson, Cohn, Price, Holman & Stern

[57] ABSTRACT

A toothbrush holder for infants including a casing body having a substantial contour of an animated character and an aperture at the top thereof, a back plate fitted to a back of the casing body, side portions projecting and integrally formed with a lower portion of the casing body with a space between the side portions, a holding arm pivotally engaged at the side portions and projecting outwardly from the space between the side portions and having a recess at an outward end for releasably holding a toothbrush therein, a lever projectable outwardly through the aperture, the lever being pivotally connected with an inward end of the holding arm and having a name-plate at a top end thereof, and a suction disk fitted to the back plate to thereby releasably fix the holder to a selected place.

3 Claims, 2 Drawing Sheets

FANCY TOOTHBRUSH HOLDER

BACKGROUND OF THE INVENTION

The present invention relates to a toothbrush holder removably fixed to a selected place of a bathroom or washing room in a house, and more particularly to a fancy looking toothbrush holder for infants or small children, which gives some motivation to children to make a habit of brushing their teeth with a feeling of pleasure and as if they are being.

Many attempts have been made in the shape and appearance of a toothbrush for infants which, however, lacks attraction and encouragement for motivation of making a habit of toothbrushing for children without an unwilling consent.

The present invention is based upon having infants see their own toothbrush hang in their own place within their reach where their own name is indicated, they will have a feeling of pride or being praised to see it. Further, if they see that their name on the name-plate disappears within a holder when they pick up their toothbrush for use and that their name on the name-plate which was hid in the holder appears again when they finish toothbrushing and hang the toothbrush on the holder, the infants will have a feeling of superiority as if they were praised. Thus, the infants will soon have a habit of toothbrushing unconsciously. Apparently, the habit of toothbrushing will enhance a sound growth of teethbridges and prevent tooth decay and pyorrhea.

SUMMARY OF THE INVENTION

An object of the present invention is to provide a fancy toothbrush holder for infants or small children which can provide an attraction to encourage infants to brush their teeth.

Another object of the present invention is to provide a toothbrush holder for infants, which enables disappearing and appearing of a name-plate when the toothbrush is used and not used, respectively.

The present invention provides a toothbrush holder for infants comprising a casing body having a substantial contour of an animated character and an aperture at the top thereof, a back plate fitted to a back of the casing body, side portions projecting and integrally formed with a lower portion of the casing body with a space between the side portions, a holding arm pivotally engaged at the side portions and projecting outwardly from the space between the side portions and having a recess at an outward end for releasably holding a toothbrush therein, a lever outwardly projectable through the aperture, the lever being pivotally connected with an inward end of the holding arm and having a name-plate at the top end thereof, and a fixing device such as a suction disk fitted to the back plate to thereby releasably fix the holder to a selected place.

According to the present invention, when a toothbrush is hung on the recess of the holding arm, the holding arm is pivoted at a pivot pin by the weight of the toothbrush to a substantially level position, with the result that the lever which is pivotally connected to the inner end of the holding arm moves up to extend outwardly through the aperture so that the name-plate is projected up above the top of the casing body, and thus the name on the name-plate can be seen. When the toothbrush is taken off from the holding arm for toothbrushing, the holding arm is pivoted in the opposite direction by the weight of the inner portions, such as the lever and the name-plate, relative to the pivot pin by the removal of the weight of the toothbrush, with the result that the lever is moved down into the casing body through the aperture and thus the name-plate is hidden in the casing body. Thus, the name on the name-plate disappears while the toothbrush is being used.

PREFERRED EMBODIMENT OF THE INVENTION

Figure 1:
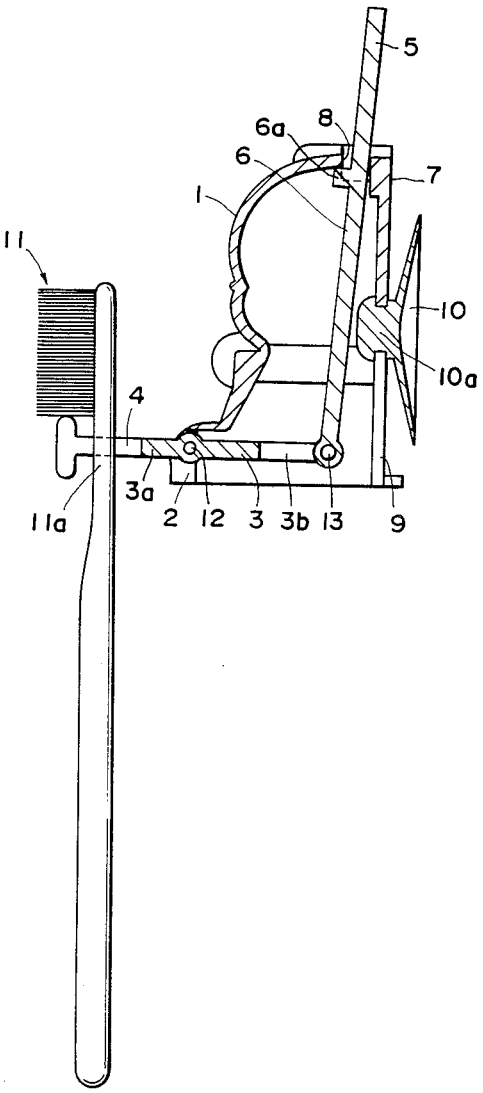
FIG. 1 is a sectional view of a toothbrush holder embodying the invention, showing that a toothbrush is hung on the holder.
Figure 2:
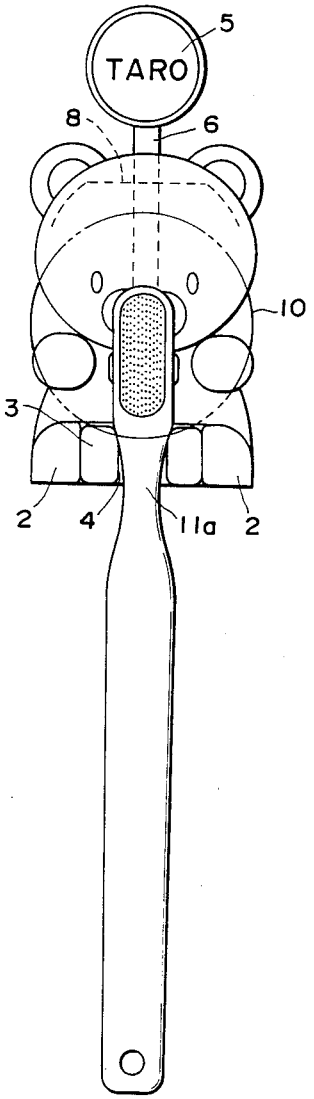
FIG. 2 is a front view of the toothbrush holder shown in FIG. 1.
Figure 3:
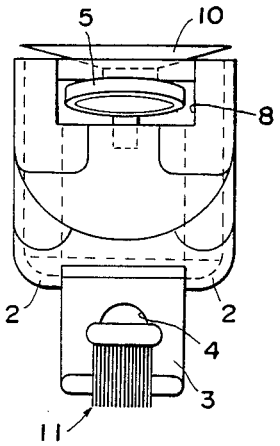
FIG. 3 is a top plan view of the toothbrush holder.
Figure 6:
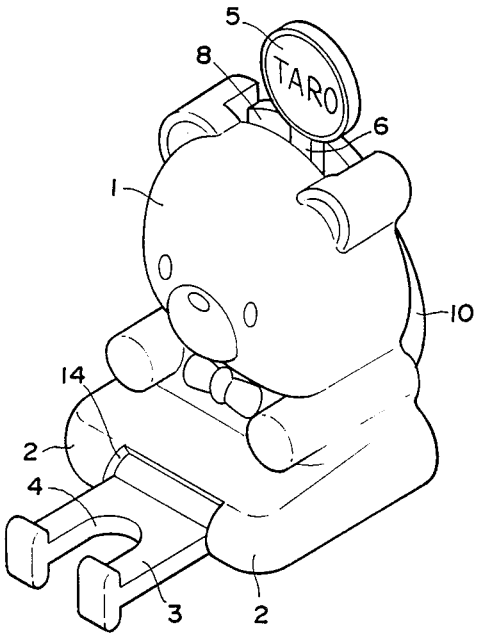
FIG. 6 is a perspective view of the toothbrush holder showing that the name plate is projected, though a toothbrush is omitted for simplification only.
Figure 4:
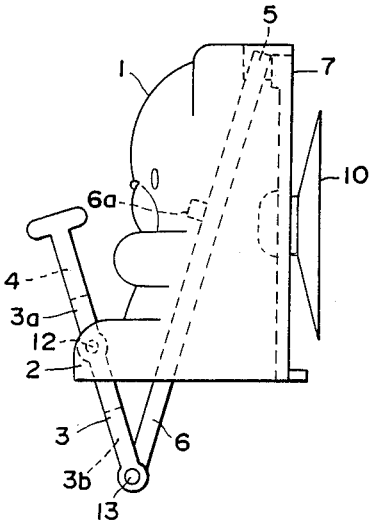
FIGS. 4 and 5 are a side view and a front view, respectively, of the toothbrush holder with the toothbrush being taken off for use.
Figure 5:
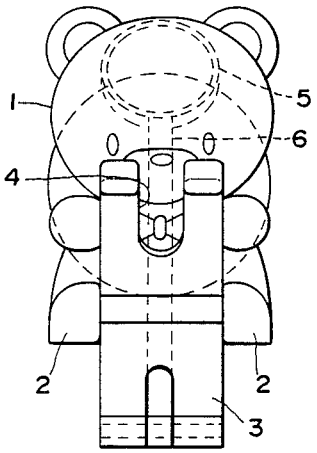

Referring to FIGS. 1 and 2, a casing body 1 of a synthetic resin formed into an animated character and the like has side portions 2,2 projecting forward in a confronting relation with a space 14 therebetween from a lower portion of the casing body 1. Between the side portions 2,2, a holding arm 3 having a recess 4 at an outwardly extended end to form "legs" of the animated character is pivotally secured to the side portions 2,2 of the casing body 1 by a pivot pin 12 which is connected to the side portions 2,2. The holding arm 3 has an outer portion **3*a* extending outwardly from the pivot pin 12 and an inner portion 3*b* extending inward into the casing body 1 from the pivot pin 12. The inner end of the holding arm 3 is pivotally connected to a lever 6 by a pivot 13. The lever 6 is extended upwards from the pivot 13 and extended outwardly from an aperture 8 formed on top of the casing body 1. The lever 6 has at its upper end a name-plate 5 and a stopper 6*a* which limits an upward movement of the lever 6. A back plate 7 is fitted to the back of the casing body 1 and has a groove 9 for movably securing a sucking disc 10 at its fixing portion 10*a* as shown in FIG. 1. The sucking disc is made of a resilient material such as a rubber or a suitable synthetic resin and serves to releasably hold the toothbrush holder at the selected place of a flat surface by the sucking effect of the disc 10**.

Name of infant who uses the toothbrush is described on the name-plate 5 as illustrated in FIG. 2, and the holder thus formed is secured on a desired place within infant's reach so that the infant can take off or hang on the toothbrush in the holder. When the toothbrush is hung on the holder so that the neck **11*a* of the toothbrush is held in the recess 4 of the holding arm 3, the holding arm 3 is immediately pivoted downwardly at the pivot pin 12 to a level position and thus projected forwardly and outwardly as if the animated character, a little bear in the illustrated embodiment, stretched its legs as illustrated in FIG. 1, by the weight of the toothbrush 11 so that the position of the pivot 13 is lifted upward, with the result that the lever 6 is moved upward until the stopper 6*a* contacts the inner end of the aperture 8 to project upwardly and outwardly from the aperture 8. Thus, the name-plate 5 on top of the lever 6 is projected upward and appears from the outside of the casing body 1**, and the infant can find his or her name on the name-plate and feel pleasant.

When the infant picks up his toothbrush 11 from the holding arm 3 of the holder 1, the holding arm 3 is pivoted in the opposite direction at the pivot pin 12 by the weight of the name-plate-side elements (5, 6) relative to the pivot pin 12, and consequently the position of the pivot 13 is shifted downward this time and the name-plate 5 is moved downwardly and hidden in the casing body of the holder. Thus, the name on the name-plate 5 disappears while the infant is brushing his or her teeth. When, however, the infants finishes toothbrushing and hangs the toothbrush on the holder in such a manner that the neck 11*a* of the toothbrush 11 is engaged in the recess 4 of the holding arm 3, the name-plate 5 is projected up again beyond the aperture 8 as illustrated in FIG. 2 and the infant can see his or her name.

In the present invention, the name-plate bearing infant's name appears when the toothbrush is hung on the holder and disappears when the toothbrush is being used. The appearance and disappearance of the name-plate will provide the infant with motivation of making a habit of toothbrushing, and the infant will willingly go and brush his or her teeth. Although the name-plate disappears within the holder while the toothbrush is taken off from the holder for use, the name-plate bearing the name appears again when the toothbrushing is finished to hang the toothbrush on the holder. This will make the infant feel pleasant and the infant will feel as if he or she were praised, and the infant will be willing to brush their teeth everyday.

Although the present invention has been described with reference to a preferred embodiment, many modifications and alterations can be made within the scope of the appended claims.

What is claimed is:

1. A toothbrush holder for infants, said toothbrush holder comprising a casing body having a substantial contour of an animated character, an aperture located at the top of said casing body, a back plate fitted to a back of said casing body, said portions integrally formed with a lower portion of said casing body, a space located between said side portions, a holding arm pivotally mounted on said side portions, said holding arm projecting outwardly from the space between said side portions, said holding arm have a recess at an outer end for releasably holding a toothbrush therein, a lever outwardly projectable through the aperture, said lever being pivotally connected with an inner end of said holding arm, a name-plate located at a top end of said lever, and a suction disk fitted to said back plate to thereby releasably fix the holder to a selected place so that the name-plate projects above the animated character when a toothbrush is located in the recess of said holding arm and the name-plate descends into the animated character due to the pivotal connection of the lever and the holding arm upon removal of a toothbrush from the recess of said holding arm.

2. The toothbrush holder according to claim 1, wherein said back plate has a groove for releasably fitting suction disk therein.

3. The toothbrush holder according to claim 1, wherein said lever has a stopper at the top end located below said name-plate so that an upward movement of said lever by a weight of a toothbrush is limited when a toothbrush is hung on said holding arm.

* * * * *